US005374796A

United States Patent [19]

Plummer

[11] Patent Number: 5,374,796

[45] Date of Patent: Dec. 20, 1994

[54] CONTACT SENSOR WITH IMPROVED SENSITIVITY

[75] Inventor: Steven J. Plummer, Hudson, Ohio

[73] Assignee: Picker International, Inc., Cleveland, Ohio

[21] Appl. No.: 144,896

[22] Filed: Oct. 28, 1993

Related U.S. Application Data

[63] Continuation of Ser. No. 799,303, Nov. 27, 1991, abandoned.

[51] Int. Cl.[5] ..... H01H 1/10

[52] U.S. Cl. ..... 200/512; 200/514; 200/515

[58] Field of Search ..... 200/512, 514, 515, 516, 200/517; 128/659, 653.1

[56] References Cited

U.S. PATENT DOCUMENTS

| | | | |
|---|---|---|---|
| 3,382,338 | 5/1968 | Arseneault | 200/517 |
| 3,551,616 | 12/1970 | Juliusburger | 200/517 |
| 4,349,712 | 9/1982 | Michalski | 200/512 |
| 4,362,911 | 12/1982 | Sears et al. | 200/517 |
| 4,602,135 | 7/1986 | Phalen | 200/512 |
| 4,684,767 | 8/1987 | Phalen | 200/512 |
| 5,056,365 | 10/1991 | Gray et al. . | |
| 5,149,923 | 9/1992 | Demeo | 200/512 |

*Primary Examiner*—Henry J. Recla
*Assistant Examiner*—David J. Walozak
*Attorney, Agent, or Firm*—T. B. Gurin; R. A. Notzen

[57] ABSTRACT

A contact sensor apparatus with improved sensitivity is provided. A frame defining a surface upon which contact detection is desired has two electrically conductive sheets held in spaced parallel relationship by a plurality of electrically non-conductive insulating spacers attached to the face thereof. A contact force distributor is sandwiched between the outside electrically conductive sheet and a graphics layer. Contact forces on the graphics layer, that are in alignment with the spacers, are redistributed to areas between adjacent spacers by the contact distributor.

20 Claims, 2 Drawing Sheets

CONTACT SENSOR WITH IMPROVED SENSITIVITY

This is a continuation of copending application Ser. No. 07/799,303 filed on Nov. 27, 1991, now abandoned.

BACKGROUND OF THE INVENTION

The present invention relates to contact detection in medical diagnostic equipment. It finds particular application in conjunction with nuclear or gamma camera systems and will be described with particular reference thereto. However, it should be appreciated that the invention will also find application in conjunction with other equipment where contact detection is desirable. Nuclear or gamma cameras include one or more detector heads which each receive radiation emanating from a patient. Each head includes a flat scintillation crystal which converts incident radiation to flashes of light. Internal electronics convert each flash of light into an indication of the location and energy of the received incident radiation event. Collimators are commonly mounted to the face of each scintillation crystal. Collimators are designed with lead vanes to limit the radiation received by the scintillation crystal to only that radiation which is coming essentially perpendicular to the face of the crystal. The height of the vanes and their spacing control the angle at which received radiation may differ from perpendicular. Different collimators are designed for different types of medical procedures. Collimators and associated scintillation crystals are secured to a mounting structure which in turn is secured to a means which provides for horizontal, vertical and rotational movement of the detector head assembly. The remainder of the head assembly is constructed to support the lead vane collimators thus the entire head assembly tends to be massive. In a typical clinical application it is desirable to position the detector head assemblies in close proximity to the portion of the patient to examined. To facilitate this positioning, head assemblies are mounted to a gantry system with the face of each detector disposed adjacent to an area of patient interest under examination. Gantry systems are generally perpendicular to the floor surface and typically provide a means for rotating detectors about an isocenter that is parallel to the floor. In multiple head assembly systems, detectors are typically positioned on the gantry at uniform angular intervals. In application, a patient under examination will lie on an examination table parallel to the floor. The patient is positioned within the gantry such that the patient to be imaged is near the gantry isocenter and each detector face is exposed to the portion of the patient to be imaged.

To optimize the imaging capability of a camera system a means is typically provided which allows the operator to position each head assembly radially toward the gantry isocenter. Additional movement capability is provided to pivot or cant each detector head assembly independent of radial movement. The radial movement means is typically a motor and gear arrangement which is controlled by the camera operator. In multi-head camera systems each head may be operatively connected to other heads in the system such that movement of all the heads occurs simultaneously. Alternatively, heads may also be selectively positioned using independent motor and gear arrangements for each detector head.

Because detector head assemblies are massive it is necessary that the gantry, the head assembly supporting means and the motor and gear means be ruggedly designed and powerful enough to safely position the head assemblies in close proximity to the patient. Because of the gantry size, the power associated with the motor and gear arrangement and the mass of the head assemblies, there is concern over patient or patient couch contact from the head assemblies during head positioning. Contact of this type is generally unintended and may result in patient injury, patient table damage or head assembly damage. To interrupt head movement in the event of unintended contact by the head assemblies, a contact sensor means is operatively positioned on the head assembly face to detect when the assembly has made contact with an object, such as a patient or the patient couch.

Known contact sensor means consist of two electrically conductive sheets in close proximity spaced parallel relationship. The conductive sheets are separated by a plurality of firm electrically non-conductive spacers fixedly positioned between the conductive sheets such that sheets are in opposition but not in electrical contact. The quantity and placement of spacers between the conductive sheets and the spacers individual sizes are selected to (1) maximize the exposed surface area between the conductive sheets, (2) facilitate a close proximity spaced parallel relationship between the opposing surfaces of the conductive sheets and (3) maintain electrical isolation between the conductive sheets while no contact force is applied to the outer surface of the contact sensor. The conductive sheets are constructed from materials which allow displacement of the sheets in a direction normal to the surface of said sheets in response to contact forces applied to the outer surface of the contact sensor in areas between adjacent spacers. In this fashion a means is provided for the conductive surfaces to make electrical contact in the areas between the spacers. After the contact forces are removed the sheets will return to their original non-electrically contacting, close proximity spaced parallel relationship. The conductive sheets are electrically connected to a control means which senses when the sheets have made electrical contact and interrupts the advance of head assembly in response. This spacer and sheet arrangement is secured to a mounting frame. The entire assembly is secured by suitable fastening means across the face of the detector head assembly exposed to the patient. The conductive sheet mounted adjacent the detector face is alternatively described as the inner conductive sheet whereas the conductive sheet intended to initially receive contact forces is alternatively described as the outer conductive sheet. The fastening means, electrically conductive sheets, spacers and mounting frame are constructed from various materials which allow radiation events emanating from the patient to pass through to the collimator and scintillation crystals. In theory, if the known sensor means contacts an object while the detector head assemblies are in motion, the outer conductive sheet will deform towards the inner conductive sheet and make electrical contact. This electrical contact is sensed by the control means which stops the advance of the head assembly. Typically, a graphics layer is laminated to the outer conductive layer for aesthetics.

The contact sensor means described above is adequate in many situations. However, if the contact sensor means contacts a hard protrusion, such as a patient's knee or elbow, at a point on the conductive sheets where a rigid spacer is situated or if the surface which the head assembly contacts is a relatively broad and firm area parallel to the face of the sensor means, such as a male patient's chest, the two conductive sheets will not make contact until there is sufficient force applied in areas between the spacers to deform the sheets thereby initiating contact between the sheets. In some instances no contact is made at all. During the time it takes for sufficient force to be applied to deform the sheets about the spacers and initiate electrical contact between the sheets, the detector heads will continue to advance possibly injuring a patient, damaging the detector head and/or patient couch. To minimize this problem it has been proposed to reduce the thickness of the non-conductive spacers. While this approach increases sensitivity it also results in reduced reliability due to the conductive layers contacting as a result of momentive forces acting upon the conductive sheets during initial movements of detector head assembly without actual contact to an object. Another alternative is to increase the distance between adjacent spacers however this approach suffers from the reliability problem previously described. Neither of these solutions fully overcomes the contact sensitivity problem described above.

The present invention contemplates a new and improved contact sensor means which overcomes the above-referenced problem and others.

SUMMARY OF THE INVENTION

Disadvantages of the prior art are reduced or overcome by the use of a contact sensor which includes a force distribution means to enhance the sensitivity of the contact sensor. The force distribution means acts to redirect contact forces from areas directly over the spacers to areas between adjacent spacers separating the electrical contact surfaces.

In accordance with one embodiment of the present invention, a first electrically conductive layer or sheet is held in spaced parallel relationship to a second electrically conductive layer or sheet by a plurality of electrically insulating spacers. A rubber, foam or sponge like material is sandwiched between the second sheet and a graphics layer. The combination of the above described sheets, spacers and sponge like material are secured to a support frame. This combination of elements comprise an improved contact sensor which in turn is secured to a movable object where contact detection is desired.

Contact forces applied to the graphics layer cause the graphics layer, the sponge like material and the second conductive sheet to simultaneously deflect towards the first conductive sheet. The contact forces cause the sponge like material to deform about the spacers separating the conductive sheets thereby redistributing the contact forces to areas between adjacent spacers. When the contact forces are removed the graphics layer, the sponge like material and the second sheet relax to their original shape breaking the contact between the first and second sheets.

In accordance with another embodiment of the present invention, a second plurality of rigid electrically insulating spacers are used between the second conductive sheet and the graphics layer in place of the sponge like material. The second plurality of spacers are securely fixed and positioned between the graphics layer and the second conductive sheet such that they are in alignment with the spaces resulting from the distribution of the first plurality of spacers between the first and second conductive sheets.

Contact forces applied to the graphics layer cause the graphics layer, second plurality of spacers and the second conductive sheet to simultaneously deflect towards the first conductive sheet. The transfer of forces from the graphics layer through the second plurality of spacers to the second sheet causes the first and second conductive sheets to contact in areas between individual spacers of the first plurality of spacers. When the contact forces have been removed the assembly relaxes to its original shape breaking the contact between the first and second sheet.

In both of the above described embodiments electrical conductors are brought out from each of the first and second conductive layers to facilitate connection to a control device which detects when the first and second sheets have made contact and initiates an appropriate response thereto.

An advantage of the present invention is that it increases contact sensitivity without affecting reliability.

Another advantage of the present invention is that it makes the contact sensor more responsive to contact forces.

Yet, another advantage of the present invention is that it improves sensor operation when in contact with hard, pointed objects or broad, firm objects resting parallel to the detector face.

The invention of the present application will be understood more fully and in more detail by reference to the following description and drawings.

BRIEF DESCRIPTION OF THE DRAWINGS

The invention may take form in various parts and arrangements of parts, and in various steps and arrangements of steps. The drawings are only for the purpose of illustrating a preferred embodiment and are not to be construed as limiting the invention.

DETAILED DESCRIPTION OF THE PREFERRED EMBODIMENTS

Figure 1:
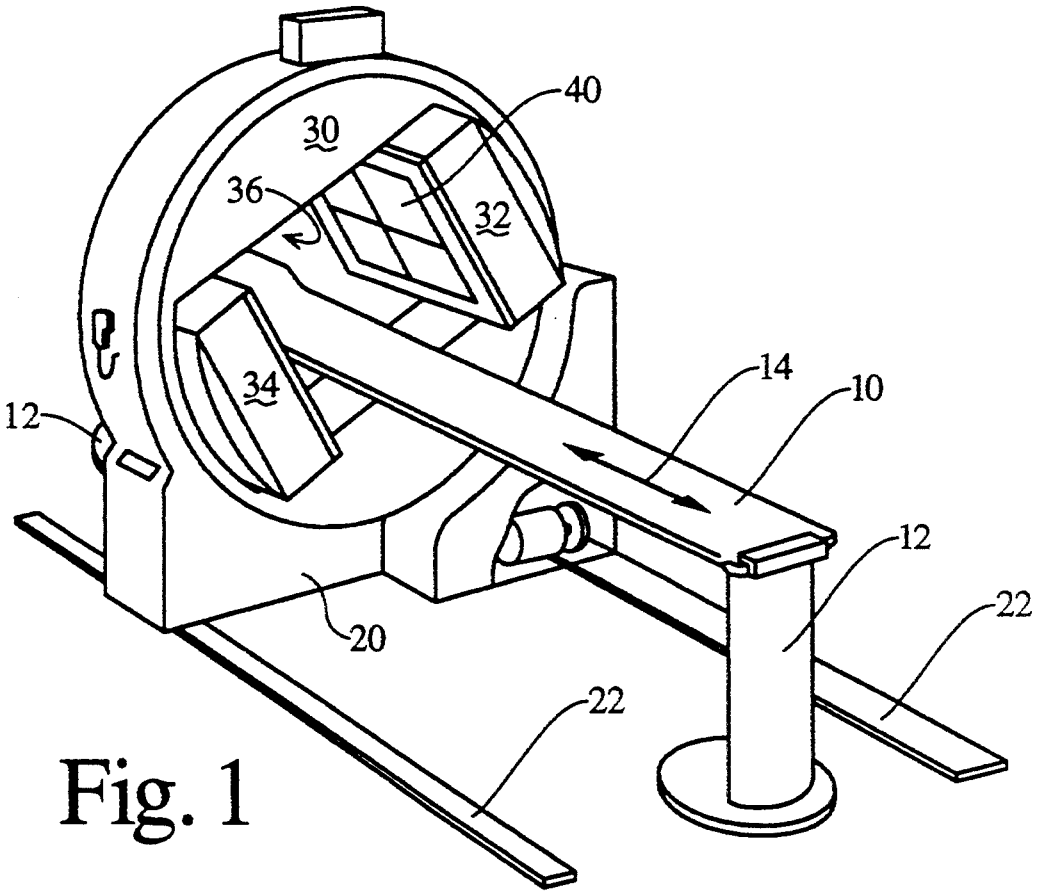
FIG. 1 is a perspective view of an exemplary gamma camera system.

With reference to FIG. 1, a patient table 10 is selectively positionable to support a patient along a longitudinal axis 14. An outer gantry 20 is movably mounted on tracks 22 which extend parallel to the longitudinal axis. An inner or rotating gantry 30 is rotatably mounted on the outer gantry. A first camera or detector head 32 is movably mounted to the inner gantry. A second camera or detector head 34 is mounted to the inner gantry opposing the first camera head. A contact sensor 40 is mounted to the face of detector head 32. Likewise, a second contact sensor (not shown) is mounted to the face of detector head 34. The inner gantry defines a central patient receiving aperture 36 for receiving a supported patient along the longitudinal axis. It is to be appreciated that more or less detector head assemblies are contemplated.

Figure 2:
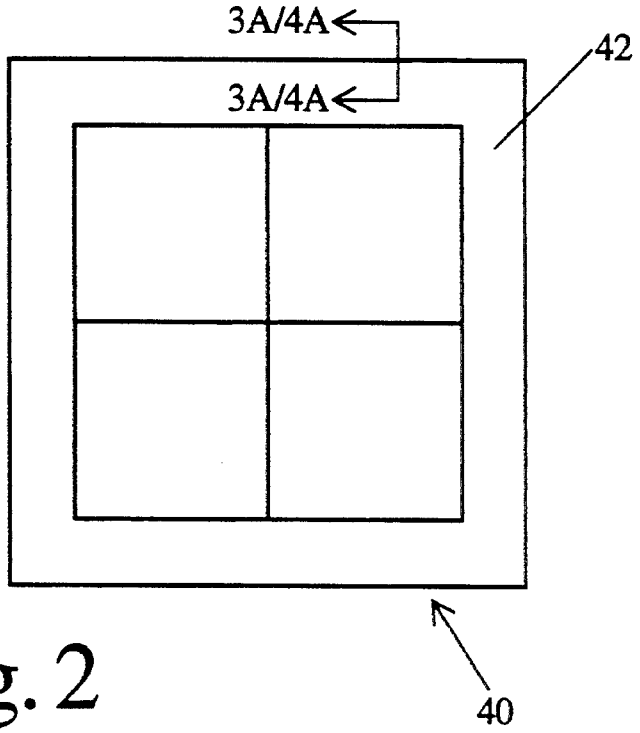
FIG. 2 is a front view of the contact sensor means in accordance with the present invention.

Each detector head includes a scintillation crystal that emits a flash of light in response to incident radiation. An array of photomultiplier tubes converts each light flash into a corresponding electrical signal. A resolver circuit resolves the (x,y) coordinates of each light flash and the energy of the incident radiation. After appropriate uniformity and linearity correction, the count or number of flashes at each (x,y) coordinate is converted to gray scale and displayed on a CRT or video monitor. Each detector head is comprised of a lead vane collimator and its associated mounting structure. With reference to FIG. 2, a contact sensing means 40 is shown in isolation from the detector head. An external graphics layer face 42 is visible in the view of FIG. 2.

Figure 3A:
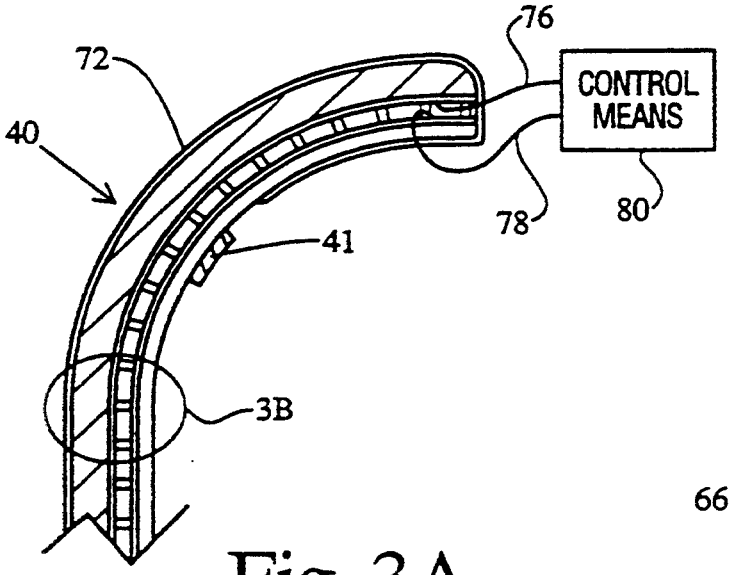
FIG. 3A is a sectional view of FIG. 2 showing a portion of a first embodiment of the present invention.
Figure 4A:
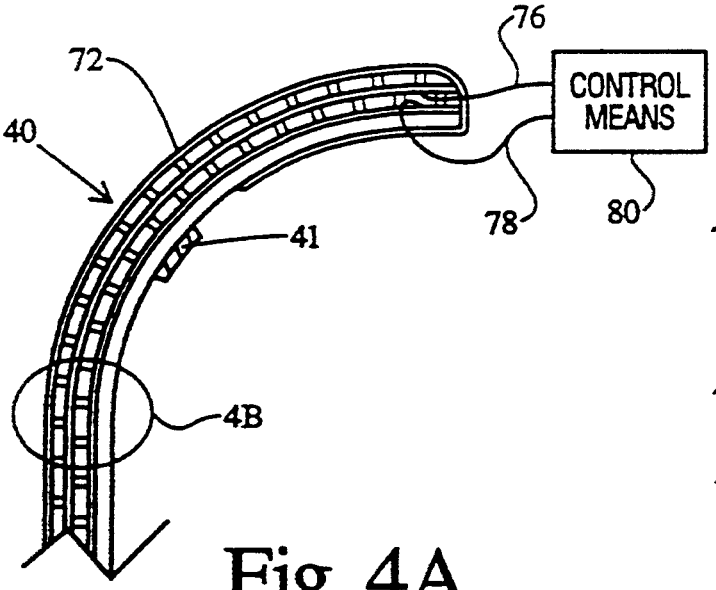
FIG. 4A is a sectional view of FIG. 2 showing a portion of a second embodiment of the present invention.

With reference to FIGS. 3A and 4A and continuing reference to FIG. 2, contact sensing means 40 is shaped to form a radius on two opposing ends to facilitate contact detection along the sides of the detector head assembly. FIGS. 3A and 4A illustrate one radius of contact sensing means 40. When secured to the detector head assembly graphics layer face 42 is the part of the camera system that is brought into close proximity to the patient.

Figure 3B:
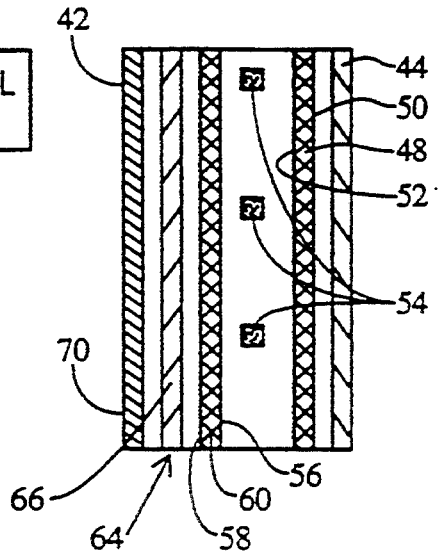
FIG. 3B is an expanded and exploded view of a portion of FIG. 3A.

With reference to FIG. 3B and continuing reference to FIG. and 3A, the contact sensor means is generally comprised of a series of layers or sheets positioned one on top of the other. In a preferred embodiment, a rigid frame 44 defines the base of the contact sensor means. Two electrically conductive layers 50 and 58 which are electrically isolated by insulating spacers 54 are fixedly positioned on frame 44. Finally, force distribution means 64 is sandwiched between conductive sheet 58 and an outer graphics layer 70. This assembly comprises the contact sensor means.

More specifically, conductive layers 50 and 58 are each comprised of electrically non-conductive insulating sheets 48 and 60 having electrically conductive materials deposited on surfaces 52 and 56 respectively. Surfaces 52 and 56 are held in opposition to one another in a spaced parallel relationship by a plurality of spacers 54. Spacers 54 are electrically non-conductive and mechanically firm. Spacers 54 are fixed between surfaces 52 and 56 in a spaced two dimensional array. Nominal spacing between adjacent spacers is 0.38 inches. A mounting frame 44 is provided to support the conductive layers on the detector head. Layer 50 is mounted to frame 44 on the non-conductive side of layer 50. A protective cover or graphics layer 70 is provided as an outer cover to the contact sensor means. Layer 70 is typically an electrically non-conductive film with graphics printed on face 42 thereof. The assembly is then mounted the detector head via double sided tape 41 or other suitable fastening means.

In the preferred embodiment, a force distribution means 64 is provided. Force distribution means 64 is comprised of a sponge like material 66 sandwiched between layers 58 and 70. The sponge like material 66 covers the entire area of the non-conductive side of layer 58.

In operation, face 42 of the contact sensor means 40 is placed in close proximity to the patient under examination. If patient contact or contact with another object is made on face 42 contact forces are applied to the contact sensor. The contact forces cause layer 70, force distribution means 64 and layer 58 to deflect simultaneously toward layer 50. Contact forces applied over surfaces in alignment with spacers 54 cause sponge-like material 66 to deform about individual spacers 54 thereby distributing contact forces in alignment with the spacers to areas around spacers 54. The redistribution of contact forces around individual spacers 54 together with contact forces applied on surfaces in areas between adjacent spacers causes contact between conductive surfaces 52 and 56 in areas between adjacent spacers 54. When the contact forces are removed from face 72 layer 70, force distribution means 64 and layer 58 relax to their original shape breaking the contact between conductive surfaces 52 and 56. It should be appreciated that the sensitivity of the contact sensor is improved through the provision of force distribution means 64. Forces applied over surfaces in alignment with spacers 54, normally lost, are in part distributed to areas between adjacent spacers. These added forces cause the sensor to activate earlier than in known devices.

In the preferred embodiment, layer 66 is comprised of a closed cell Neoprene rubber sponge sheet, approximately one-hundred and twenty-five mils thick of approximately 50 Durometer hardness. However, it should be appreciated that different materials of varying thicknesses and varying harnesses may work equally as well.

Figure 4B:
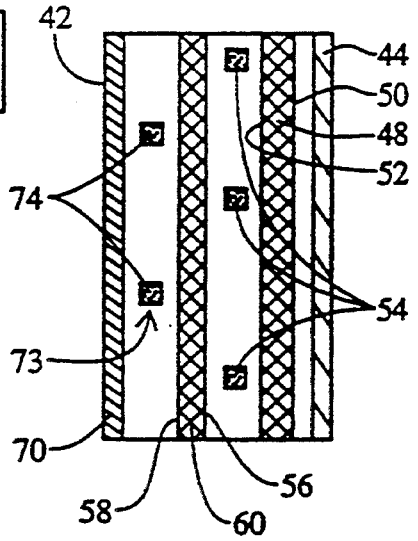
FIG. 4B is an expanded and exploded view of a portion of FIG. 4A.

With reference to FIGS. 4A and 4B and continuing reference to FIG. 1, a second embodiment is described. The construction of contact sensor 40 relating to layers 44, 50, 58 and spacers 54 remains the same as described above with reference to FIGS. 3A and 3B. The following discussion will focus on an alternative force distribution means to achieve the advantage of the present invention. In the second embodiment, the force distribution means 73 comprises a second plurality of spacers 74 fixedly secured between layers 58 and 70, in place of sponge like sheet 66. Spacers 74 hold sheets 58 and 70 in spaced parallel alignment. The second plurality of spacers 74 are distributed between layers 58 and 70 such that the second plurality of spacers are in alignment with the spaces defined between the first plurality of adjacent spacers 54 sandwiched between conductive layers 50 and 58.

In operation, if patient contact or contact with another object occurs on face 42 contact forces are applied to the contact sensor. The contact forces cause layer 70, force distribution means 74 and layer 58 to deflect simultaneously toward sheet 50. Contact forces applied to portions of face 42 are distributed by layer 70 to spacers 74. The contact force distributed to spacers 74 is transferred to layer 58 in areas between adjacent spacers 54. The transfer of force to layer 58 causes face 56 to deflect towards face 52. When the contact force has increased sufficiently faces 52 and 56 will electrically contact. When the contact forces are removed from face 42 sheets 70 and 58 relax to their original shape breaking the contact between conductive surfaces 52 and 56.

In both of the above describe embodiments conductive faces 52 and 56 are independently electrically connected by conducting means 76 and 78 to a control means (80) which senses when the sheets have made electrical contact and initiates a response thereto.

In both of the above described embodiments spacers 54 and 74 are approximately 0.060 inches in diameter, approximately 0.010 inches tall and are fixedly positioned approximately 0.38 inches from one another. It is to be appreciated that these dimensions should not be construed as limiting the invention and are only provided to impart a better understanding of the preferred size to the reader.

FIGS. 3A, 3B, 4A and 4B are intended to illustrate the physical relationship of the respective materials and should not be construed to be to scale or as an indication of the relative thickness of materials to one another. It should be appreciated that if frames 44 and material 66 are comprised of electrically non-conductive materials then layer 50 and 58 could be constructed entirely from electrically conducting materials without affecting the operation of the contact detecting means.

The invention has been described with reference to preferred embodiments. Obvious modifications and alterations will occur to others upon reading and understanding the preceding specification. It is intended that the invention be construed as including all such alterations and modifications to the full extent they come within the scope of the appended claims or the equivalents thereof.

Having described the preferred embodiments the invention is now claimed to be:

1. An area contact detection apparatus comprising;

a fast electrically conductive sheet;

a second electrically conductive sheet;

said first and second conductive sheets arranged in opposed spaced parallel relationship;

a plurality of discrete and electrically non-conductive spacers positioned between said first and second conductive sheets for maintaining said spaced parallel relationship, said spacers defining voids therebetween; and a force distribution means covering a substantial portion of one of said first and second conductive sheets and in continuous contact association with said covered sheet over the substantial portion, said force distribution means defining a contact area of sufficient expanse for contact detection at a plurality of arbitrary portions of the contact area and for distributing contact forces applied to said arbitrary portions of the contact area, each of said arbitrary portions encompassing at least a portion of a spacer and a void adjacent thereto wherein at least a portion of the contact force applied in alignment with said spacer is distributed to the adjacent void such that said distributed force acts to deflect the conductive sheet in contact with said force distribution means into the void thereby urging the conductive sheets into contact.

2. An apparatus as set forth in claim 1 wherein the force distribution means comprises;

a sponge like material.

3. An area contact detection apparatus comprising:

a first electrically conductive sheet:

a second electrically conductive sheet:

said first and second conductive sheets in opposed spaced parallel relationship:

a first plurality of electrically non-conductive spacers arranged in an array between said first and second conductive sheets for maintaining said spaced parallel relationship, said spacers defining voids therebetween:

a third sheet in opposed spaced parallel relationship with one of said first and second conductive sheets; and a second plurality of spacers arranged in an array between said third sheet and the one of said first and second conductive sheets, said second plurality of spacers generally aligned with the voids defined by the first plurality of spacers for distributing contact forces applied to an arbitrary portion of the third sheet, said arbitrary portion in alignment with at least a portion of one spacer of the first plurality of spacers and the void adjacent thereto wherein at least a portion of the contact force in alignment with said spacer is distributed to the adjacent void thereby urging the first and second electrically conductive sheet into contact.

4. An apparatus as set forth in claim 1 further comprising;

a first conducting means for electrically connecting said first conductive sheet to a control means disposed remote from said contact detection apparatus;

a second conducting means for electrically connecting said second conductive sheet to said control means.

5. An apparatus as set forth in claim 1 wherein the first conductive sheet comprises;

an electrically non-conductive sheet; and an electrically conductive surface on a face of said sheet.

6. An apparatus as set forth in claim 5 further comprising;

a conducting means for electrically connecting said first conductive sheet to a control means disposed remote from said contact detection apparatus.

7. An apparatus as set forth in claim 1 wherein the second conductive sheet comprises;

an electrically non-conductive sheet; and an electrically conductive surface on a face of said sheet.

8. An apparatus as set forth in claim 6 further comprising;

a conducting means for electrically connecting said second conductive sheet to a control means disposed remote from said contact detection apparatus.

9. The apparatus as set forth in claim 1 disposed on a diagnostic imaging apparatus for determining when said apparatus has contacted an object under examination.

10. A diagnostic medical imaging system comprising:

an object support table having a surface for supporting an object to be examined;

a radiation detecting means;

a gantry for movably supporting the radiation detecting means relative to the support table; and a contact detection means disposed on a face of said radiation detecting means for sensing when said radiation detecting means has contacted at least one of the object and the support table, said contact detection means comprised of:

first and second electrically conductive sheets arranged in opposed spaced parallel relationship;

a plurality of electrically non-conductive spacers arranged in an array between the opposing faces of the first and second sheets for maintaining said first and second conductive sheets in spaced parallel relationship, said spacers defining voids between adjacent spacers; and a force distribution means covering a substantial portion of one of said first and second conductive sheets on the contact side of said contact detection means, said force distribution means in continuous contact association with said covered sheet over the substantial portion, the other one of said first and second conductive sheets disposed adjacent the face of the radiation detecting means;

said force distribution means distributing a portion of a contact force applied to an arbitrary portion of the force distribution means and in alignment with at least a portion of a spacer and the void adjacent said spacer to the one of said first and second conductive sheets, said distributed contact force urging the first and second conductive sheet into contact.

11. The diagnostic medical imaging system as set forth in claim 10 wherein the force distribution means is comprised of a sponge like material.

12. The diagnostic medical imaging system as set forth in claim 10 further including a third sheet arranged on the side of the force distribution means Opposite the side in contact with the one of said first and second conductive sheets.

13. The diagnostic medical imaging system as set forth in claim 12 wherein the force distribution means is comprised of a second plurality of spacers arranged in an array between the one of said first and second conductive sheets and the third sheet, said second plurality of spacers generally aligned adjacent the voids defined between adjacent spacers of the first plurality of spacers.

14. The diagnostic medical imaging system as set forth in claim 13 wherein the third sheet is an electrically non-conductive layer.

15. The diagnostic medical imaging system as set forth in claim 10 further including a radius along an edge of the contact detection means for facilitating contact detection along the sides of the contact detection means.

16. The diagnostic medical imaging system as set forth in claim 10 further including a rigid sheet frame disposed between the contact detection means and the radiation detecting means face for supporting said contact detection means adjacent said radiation detecting means face.

17. The diagnostic medical imaging system as set forth in claim 10 wherein at least one of the first and second conductive layers are comprised of an electrically non-conductive sheet having an electrically conductive surface disposed at least on the side of said sheet in contact with said spacers.

18. An area contact detection apparatus comprising:

first and second electrically conductive sheets arranged in opposed parallel relationship, said conductive sheets defining normally open switch contacts;

a plurality of discrete insulating spacers arranged in an array between the first and second sheets thereby maintaining the sheets in the opposed spaced parallel relationship, said spacers defining voids between adjacent spacers; and a force distribution means disposed in continuous contact association with and covering a substantial portion of a surface of one of said first and second conductive sheets opposite said spacer array, said force distribution means, in response to contact force being applied to an arbitrary portion thereof, deforming over an area larger than the arbitrary portion, said arbitrary portion comprising a portion of a void adjacent a spacer wherein said void portion is in alignment with said applied force on said arbitrary portion, said deformation over the larger area encouraging contact between the conductive sheets over the larger area, said larger area comprising void space in addition to the void space encompassed by said arbitrary area.

19. The contact detection apparatus of claim 18 wherein the force distribution means is comprised of a sheet of sponge like material.

20. The contact detection apparatus of claim 18 wherein the force distribution means is comprised of:

a third sheet; and a second plurality of insulating spacers arrayed between the third sheet and the one of the first and second conductive sheets, said second plurality of spacers maintaining the one of the first and second conductive sheets in spaced parallel relationship with said third sheet, said second plurality of spacers arranged in an array generally opposite the voids between adjacent spacers disposed between the first and second sheets.

* * * * *